United States Patent [19]

Arnold et al.

[11] Patent Number: 4,862,370

[45] Date of Patent: Aug. 29, 1989

[54] INTERFACE AND CONTROL UNIT FOR A DIESEL ENGINE ELECTRONIC CONTROLLER AND GLOW PLUG CIRCUITS, AND METHOD OF GLOW PLUG OPERATION

[75] Inventors: Brigitte Arnold, Stuttgart; Franz Eidler, Vaihingen/Enz; Wolf Wessel, Oberriexingen, all of Fed. Rep. of Germany

[73] Assignee: Robert Bosch GmbH, Stuttgart, Fed. Rep. of Germany

[21] Appl. No.: 34,389

[22] Filed: Apr. 2, 1987

[30] Foreign Application Priority Data

Jul. 22, 1986 [DE] Fed. Rep. of Germany ..... 3624664

[51] Int. Cl.[4] ..... F02P 19/02

[52] U.S. Cl. ..... 364/431.10; 364/431.04; 364/431.12; 123/179 BG; 123/179 H; 123/145 A

[58] Field of Search ..... 123/179 BG, 493, 179 R, 123/179 H, 179 B, 145 A; 364/431.05, 431.06, 431.07, 431.09, 431.10, 431.11, 431.04, 431.12

[56] References Cited

U.S. PATENT DOCUMENTS

| | | | |
|---|---|---|---|
| 4,088,109 | 5/1978 | Woodruff et al. | 123/179 H |
| 4,491,100 | 1/1985 | Yasuhara | 123/145 A |
| 4,552,102 | 11/1985 | Egle | 123/179 BG |
| 4,566,410 | 1/1986 | Demizu | 123/179 BG |
| 4,639,871 | 1/1987 | Sakai et al. | 364/431.10 |
| 4,694,145 | 9/1987 | Romstadt et al. | 123/179 H |

OTHER PUBLICATIONS

Stumpp-"Strategy for a Fail-Safe Electronic Diesel Control System for Passenger Cars", SAE Technical Paper Series 830527 International Congress and Exposition, Detroit, Mich., Feb. 28-Mar. 4, 1983; pp. 77-84.

Walz et al-"Progress in Electronic Diesel Control", SAE Technical Paper Series 840442, International Congress and Exposition, Detroit, Mich., Feb. 27-Mar. 2, 1984; pp. 21-29.

Eisele-"Electronic Control of Diesel Passenger Cars", SAE Technical Paper Series 800167, Congress & Exposition, Cobo Hall, Detroit, Feb. 25-29, 1980; pp. 1-8.

*Primary Examiner*—Eugene R. LaRoche
*Assistant Examiner*—Seung Ham
*Attorney, Agent, or Firm*—Frishauf, Holtz, Goodman & Woodward

[57] ABSTRACT

To permit ready matching of a Diesel engine operating circuit to a glow plug system, an interface-and-control unit (1) is provided which includes a microprocessor (MP) which decodes data words received from an engine control unit (MS). The data words are in the form of serially transmitted bits which define, by time duration of the bits. respectively logic "0" and logic "1" values to provide, inherently, simultaneously data information and synchronizing information. For example, the logic "0" bits may be $\frac{1}{8}$ of a predetermined clock period (T) whereas the logic "1" bits may be $\frac{1}{2}$ of the clock period (T). The microprocessor, thus, can be easily matched to engines of different types and can carry out, on its own, diagnostic routines and indicator functions under command of respective bits being transmitted thereto. Preferably, glow plug current is provided in pulsed form, the duty cycle of which is controlled by four data bits (D0-D4) transmitted to the microprocessor (MP).

20 Claims, 1 Drawing Sheet

INTERFACE AND CONTROL UNIT FOR A DIESEL ENGINE ELECTRONIC CONTROLLER AND GLOW PLUG CIRCUITS, AND METHOD OF GLOW PLUG OPERATION

The present invention relates to electronic control of Diesel engines, and more particularly to an interface and control unit for combination with an electronic Diesel engine control unit and a glow plug circuit, particularly for use with automative-type Diesel engines.

BACKGROUND

Diesel engines, and particularly small Diesel engines which are used for example in automotive vehicles, may have one or more glow plugs which are connected in an electrical circuit. The glow plugs extend into the cylinder of the engine, to provide for preheating of the cylinder wall and air being compressed in the cylinder as the engine is being started. The glow plugs are energized shortly before starting of the engine. Just after starting, the glow plugs can continue to be energized, however with reduced power, depending on the temperature then pertaining in the interior of the cylinder, so that continued combustion in the respective cylinders can be sustained upon injection of fuel into the compressed air.

It is customary to include a control indicator, for example a control lamp, in the circuit of the glow plugs. Some arrangements also include a monitoring system or monitoring circuit to check and supervise the operation of the glow plugs.

The glow plug circuit, or overall glow plug system, can be controlled from a central motor control unit. Such central motor control units may be electronic units which store in a suitable memory various control commands, which are supplied to a decoding circuit which, in turn, controls the respective components of the glow plug system.

Decoding circuits, which decode commands to control sequential operation of glow plugs—for example with different energy levels in dependence on engine operation or temperature—are known. Decoding circuits have to be matched to the specific application after they have been built. If, after the decoding circuit has been built, it becomes desirable to change the engine operating characteristics, for example by changing starting speed or the like, it is not readily possible to change the decoding circuit to match the changed engine characteristics. The decoding circuits are usually part of the interface between the engine control unit and the glow plug circuit. Monitoring of operation of the glow plugs is usually commanded by the engine control unit; the interface, as such, in the past has not carried out any monitoring functions, that is, could not carry out on its own a checking or monitoring subroutine.

THE INVENTION

It is an object to provide a glow plug control system which can be used as an interface between an engine control unit and a glow plug circuit, and which is so constructed that the basic system can be readily adapted or matched to various types of engines, be readily changeable to meet changed engine characteristics or specific operating data, and which, further, can carry out on its own checking or monitoring or other supervisory functions.

Briefly, the glow plug control system—which can be used as an interface—includes a microprocessor which is coupled to the engine control unit. The engine control unit and the microprocessor are arranged, with respect to each other, such that the engine control unit provides output signals in the form of serial data words which provide, simultaneously, synchronizing and data information from the engine control unit to the microprocessor. The serial data words, for example, include several data bits, the time duration of which—with respect to a given clock—indicates whether the respective bit is a ZERO or a ONE, a flank of which at the same time provides synchronizing information. The microprocessor decodes the serial data words. It is coupled, in turn, to the glow plug circuit. Monitoring and indicators which monitor the extent of current flow to the glow plug curcuits and which provide indicating signals are coupled to the microprocessor. Thus, excess or unusual current flow—which includes absence of current flow due, for example, to a broken glow plug or glow plug connection, can be fed back directly to the microprocessor which, in turn, can provide output signals to an indicator which, for example, may be a warning or control lamp, an alphanumeric display, or the like.

In accordance with a preferred feature of the invention, the logic bits are distinguished by short pulses, for example $\frac{1}{8}$ the time of a given clock, and long pulses, for example $\frac{1}{2}$ the time of the same clock. The microprocessor can readily be programmed to carry out, on its own, diagnostic routines to supervise and monitor the function of the glow plugs, and the glow plug circuits controlled thereby.

The system has the advantage that the use of a microprocessor in the interface easily permits matching the requirements of the glow plug circuit to a specific engine without change in the command signals derived from the engine controller. It is only necessary to then change the programming sequence or the data on which the programming sequence is based within the microprocessor of the interface-control unit. The microprocessor, which need not be as powerful as that to control the engine operation of the vehicle as a whole, preferably can be so constructed that it already contains various types of data for different applications which, then, can be selected by the engine controller by providing command signals from the engine controller to the interface-control unit.

Utilizing serial data words, in which the respective bits are of different time duration and represent, depending on their timing, a logic "0" or a logic "1", and simultaneously provide synchronizing information, has the additional advantage that the microprocessor in the interface and control circuit, and the entire interface and control circuit, then are highly immune to external noise or disturbance influences. The time difference between the bits which represent a logic "0" and a logic "1" preferably is substantial, for example $\frac{1}{8}$ of a given clock duration representing a logic "0" and $\frac{1}{2}$ of the clock duration a logic "1".

In accordance with a feature of the invention, the microprocessor in the control and interface unit carries out diagnostic routines with respect to the apparatus controlled by the interface and control unit. For example, and suitably at regularly recurring intervals, the resistance of the glow plugs is measured. When the resistance of the glow plugs falls beyond a given range, a malfunction indication is then provided, for example by illuminating a control lamp or, if the vehicle is so equipped, by providing a suitable "malfunction" or warning display. If the glow plug current is excessive, a short-circuited plug or short circuit in the specific circuit is indicated; if the current is too low, or absent, a break in the connection line or in the glow plug itself is indicated.

The data words which are applied from the motor control unit to the interface and control system preferably include not only the bits necessary to control glow plug current but, additionally, further information bits which can be decoded by the interface and control unit to provide additional information to the operator of the vehicle, for example to energize a control lamp indicating that the glow plugs are carrying out a preglowing function or to control the interface and control system to initiate a diagnostic routine. The data word preferably contains an additional bit which, although not necessary for all applications, can be reserved for special applications or for later expansion of the system.

Glow plug current is provided, under control of the interface and control system, in the form of current pulses, the duty cycle of which may depend on glow plug temperature, battery voltage, and the like. For example, if the battery voltage should be low, due for instance to outside low temperatures, current to the glow plugs is provided continuously for a predetermined time interval; conversely, if the battery voltage should be high, or after the engine has started, the average current supplied to the glow plugs can be reduced by changing the duty cycle of the current pulses to provide for shorter pulses with longer intervening pulse gaps.

DRAWINGS

Figure 3:
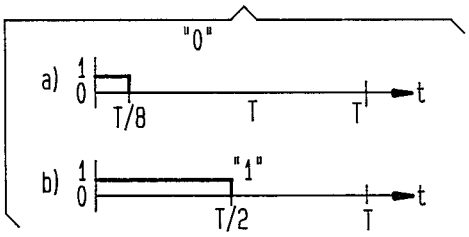

FIGS. 3(*a*), 3(*b*) illustrate two pulse diagrams of data bits; and

Figure 4:
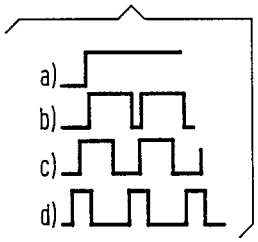

FIGS. 4(*a*), 4(*b*), 4(*c*) and 4(*d*) illustrate current flow, with respect to time, to the glow plugs.

DETAILED DESCRIPTION

An automotive Diesel engine—of standard construction and not shown in the drawings for simplicity—is controlled by an engine control unit MS. The engine control unit MS may be of any suitable and standard construction and, for example, store, in a memory operating data relating quantity of fuel injected to speed, loading on the engine, operation with or without supercharging, and the like, to properly control the engine for maximum power, maximum fuel economy, or otherwise as desired. Such engine control units by themselves are known, and the engine control unit MS does not form part of the present invention.

Figure 1:
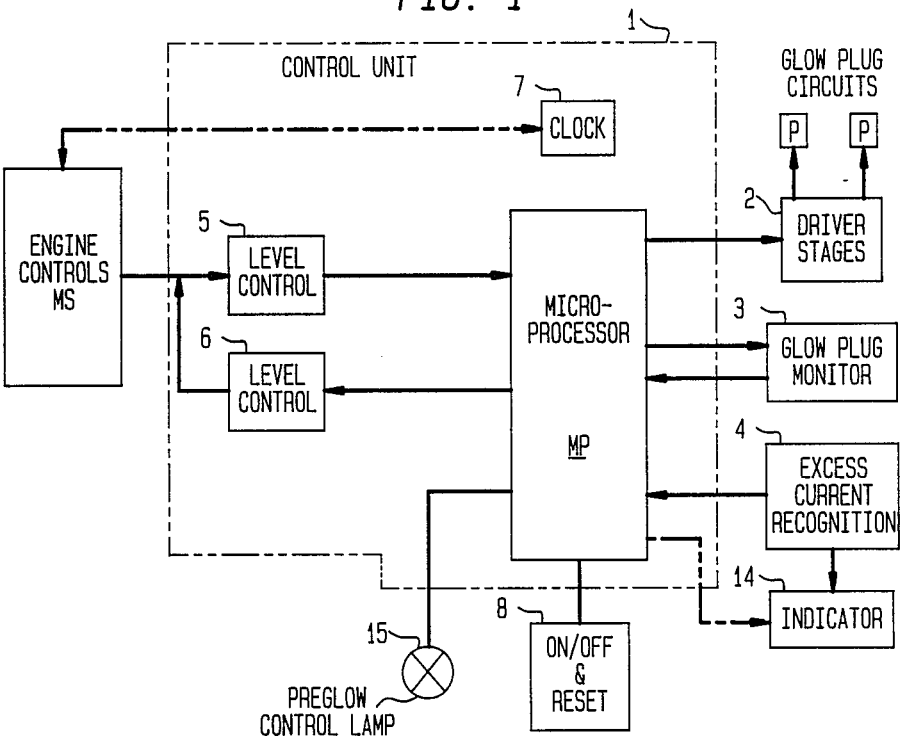
FIG. 1 is a general block circuit diagram of the control and interface system in accordance with the invention.

The engine control unit also provides output signals to control glow plugs of th engine when the engine is to be started. To start the engine, output data are provided from the engine control unit MS to an interface-control system, which includes a control unit 1, shown in FIG. 1 within a chain-dotted outline. The control unit 1 includes a microprocessor MP. The microprocessor MP, at its output, controls a plurality of driver stages 2 which, in turn, are connected to respective glow plug circuits P, associated with the individual cylinders of a multi-cylinder engine. The glow plug circuits P are shown only schematically, and include the glow plugs themselves and suitable connection lines connected, for example, through the driver stages 2 to a vehicle battery. Additionally, the microprocessor provides output signals and receives input signals from a glow plug monitor circuit 3. The glow plug monitor circuit 3 may, for example, include a temperature sensor, for each one of the glow plugs which may be combined with the glow plug structure themselves. Additionally, an excess current recognition circuit 4 is connected to the microprocessor which measures current to the glow plug circuits P, in combination or individually, and provides an output signal, directly, to an indicator 14 or provides its output signal to the microprocessor which, in turn, provides output signals to the indicator as shown by the broken line from microprocessor MP to the indicator 14. Both the full line as well as the broken-line circuits to the indicator 14 may be provided. The excess current recognition circuit may, for example, simply be a resistor, the drop across which is being sensed; if the voltage drop across the resistor is excessively low, an open circuit to the respective glow plug is indicated; if the voltage drop across the resistor is excessively high, excess current is recognized, and the indicator will be rendered effective. The indicator may, for example, be a control lamp or in form of an alphanumeric display, for example a liquid-crystal display (LCD), in which case it is preferably controlled from the microprocessor MP.

The control unit 1 has a level control unit 5, which receives the signals from the engine control unit MS, in order to convert the received signals to the voltage level and polarity which is used by the microprocessor MP. The level control unit 5 may, further, inherently include an input filter which eliminates undesired interference and noise signals. To feed back data from the microprocessor MP to the engine control system, a similar level control unit 6 is coupled to between the microprocessor MP and the return signal path to the engine control unit MS which, again, matches the signal levels utilized by the microprocessor MP to the signal characteristics required by the engine control unit MS. A clock source 7 is coupled to or forms part of the microprocessor MP. Additionally, an ON/OFF and reset control 8 is provided, coupled to the microprocessor MP to permit ON and OFF connection and resetting of the microprocessor.

Figure 2:
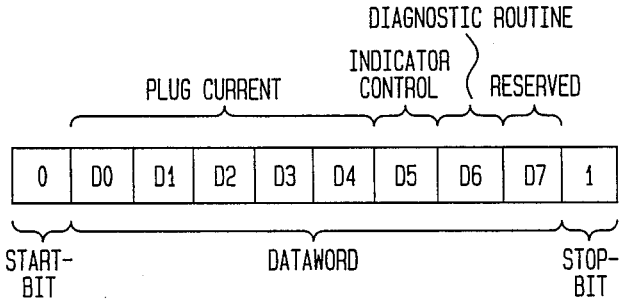
FIG. 2 is a schematic diagram of a command word received from the engine control unit.

In accordance with a feature of the invention, the data words provided by the engine control unit MS to the control unit 1 are of the type illustrated in FIG. 2. These data words have a first starting bit, which indicates the beginning of the data word to the microprocessor MP and a stop bit, which indicates that the data word is at an end. Between the start and stop bits which, for example, respectively may be a logic "0" and a logic "1", eight data bits are transmitted. Data bits D0 to D4 command the duty cycle of glow plug current. The data bit D5 can be used to control the microprocessor MP to energize the control lamp indicator, that is, to provide an indication to the operator that the preglowing by energization of the glow plug circuits P is in effect. Such a preglowing indicator is shown schematically at 15, coupled to the microprocessor MP. The data bit D6 can be used to command the microprocessor to initiate a diagnostic routine, for example to energize a glow plug monitoring circuit and sequentially the excess current recognition circuit and then, unless the excess current recognition circuits indicates current within a predetermined limit, energize the indicator 14.

Data bit D7 is not necessary or needed for the specific system described; it is, however, preferably transmitted, for example in form of a "0" signal, reserved for special tasks or program steps. For example, the indicator 14 may also be energized via D7 to indicate irregularities of the engine control system MS.

The form of the respective data bits is seen in FIG. 3. Graph (a) of FIG. 3, which is drawn to the same time scale as graph (b) of FIG. 3, shows that a data bit "0" has a pulse duration of T/8 of a given clock pulse length T. The graph (b) shows a data bit "1" value, which shows a time duration of T/2. Transmitting a pulse also for a logic "0" permits utilization of each of the data bits, at the sme time, as a synchronizing bit. The clock 7 of the control unit 1 is preferably coupled also to the clock of the engine control MS, although this, then, is not strictly necessary since synchronization is effected by each one of the bits of the data words themselves, e.g. by the leading flank.

The type of current which can be controlled by the respective plug current control bits D0 to D4 is shown in graphs (a) to (d) of FIG. 4. Thus, for low-battery voltage, continuous current, FIG. 4, graph (a), may be controlled. For average battery voltage, current as shown, for example, in graph (b) can be controlled. For very high battery voltage, or, after the plugs have reached a given operating temperature, the average current can be reduced—see graph (c) of FIG. 4. Shortly before termination of preglowing, and for example after the engine has started, the plug current can be further reduced see, for example, graph (d) of FIG. 4.

Various changes and modifications may be made within the scope of the inventive concept.

An engine control system MS, with which the present method and system can be used, is described in SAE 800767/SAE 830527/840442 A suitable microprocessor MP is: MC 6804P2 (Motorola) The level control units 5, 6, together with filters, may, for example, be elements: Comparator LM2507 (Texas) For general disclosures of engine control units, such as unit MS, reference is made to: IEEE-SAE publications on Automotive Electronics, and, further, to: Second International Conference on Automotive Electronics, 29 Oct.–2 Nov. 1979, published by The Institution of Electrical Engineers, London.

We claim:

1. In combination with a Diesel internal combustion engine (ICE) electronic control unit (MS) which processes operating parameter data and generates data words containing generalized non-engine-specific glow plug control signals.

a glow plug control system (1) forming an interface between the engine control unit (MS) and glow plug circuits (P), wherein said control system (1) controls current in the glow plug circuits, monitoring and indicating means (3, 4, 14, 15) are provided, said control system (1) additionally controlling said monitoring and indicating means to provide for indication and supervision of operation of said glow plug circuits, said glow plug control system comprising, in accordance with the invention, a microprocessor (MP) coupled to, and receiving said data words from, said engine control unit (MS), said data words each comprising a plurality of pulses in which both signal level and pulse duration are modulated, thereby simultaneously transmitting numeric information and synchronization information;

said microprocessor (MP) decoding said data words and being coupled to said glow plug circuits (P) and to said monitoring and indicating means (3, 4, 14, 15) and generating engine-specific current control signals to glow plug driver and monitoring circuits (2, 3, P) and providing monitoring and indicating signals to said monitoring and indicating means.

2. The system of the combination of claim 1, wherein the data words comprise a logic "0" bit having a short pulse duration and a logic "1" bit of substantially longer pulse duration.

3. The system of the combination of claim 2, wherein the substantially longer pulse duration is four times as long as said short pulse duration.

4. The system of the combination of claim 2, wherein the bits are transmitted in the form of pulses at a predetermined clock rate (T);

the pulse length of a logic "0" bit comprises $\frac{1}{8}$ of a clock duration (T/8) and the pulse duration of a logic "1" bit comprises $\frac{1}{2}$ of a clock duration (T/2), to provide, by transmitting pulses respectively representative of logic "0" and logic "1" data, inherently synchronizing information in addition to the data information.

5. The system of the combination of claim 1, wherein the microprocessor carries out diagnostic routines for checking for normal resistance in the glow plug circuits (P) and of said monitoring and indicating means.

6. The system of the combination of claim 1, wherein each data word comprises a plurality of bits (D0–D4) representative of average glow plug current; a bit (D5) controlling the microprocessor to provide output indication of the then pertaining operation of the glow plug circuits (P), and a bit (D6) to initiate a diagnostic routine.

7. The system of the combination of claim 6, wherein said data word includes an additional bit (D7) for reserved or special control functions.

8. The system of the combination of claim 6, wherein the glow plug current is a pulsed current;

and wherein the bits (D0–D4) controlling glow plug current comprises controlling the duty cycle of the pulsed current to the glow plug circuits (2, P).

9. The system of the combination of claim 8, wherein the data words comprise a logic "0" bit having a short pulse duration and a logic "1" bit of substantially longer pulse duration.

10. A method of controlling and supervising the operation of glow plug circuits (2, P) as a function of non-engine specific control signals generated by an electronic Diesel internal combustion engine (ICE) control unit (MS) based upon operating parameter data, comprising, in accordance with the invention, the steps of providing a glow plug control unit (1) having a microprocessor (MP);

circulating between the engine control unit (MS) and the microprocessor (MP) control signals which are characterized by a plurality of serially transmitted bits (D0–D7) defining a data word and in which each bit is represented by a signal whose level and duration are both modulated, thereby permitting simultaneous transmission of synchronization information and numeric information;

decoding said data bits in said microprocessor (MP); and generating, in said microprocessor, engine-specific control output signals to said glow plug circuits (2, P) and additionally controlling monitoring and indicating means (3, 4, 14, 15) and commanding, under control of said control signals, diagnostic subroutines including testing of whether resistance in each glow plug circuit falls within a predetermined normal range.

11. The method of claim 10, wherein the data words comprise a logic "0" bit having a short pulse duration (T/8) and a logic "1" bit of substantially longer pulse duration (T/2).

12. The method of claim 11, wherein the substantially longer pulse duration is four times as long as said short pulse duration.

13. The method of claim 12, wherein the bits are transmitted in the form of pulses at a predetermined clock rate (T);

the pulse length of a logic "0" bit comprises $\frac{1}{8}$ of a clock duration (T/8) and the pulse duration of a logic "1" bit comprises $\frac{1}{2}$ of a clock duration (T/2), to provide, by transmitting pulses respectively representative of logic "0" and logic "1" data, inherently synchronizing information in addition to the data information.

14. The method of claim 10, including the step of commanding a diagnostic routine for functional monitoring of said glow plug circuits and indicator means (3, 4, 14, 15) controlled by the microprocessor (MP).

15. The method of claim 10, wherein each data word comprises a plurality of bits (D0–D4) representative of average glow plug current; a bit (D5) controlling the microprocessor to provide output indication of the then pertaining operation of the glow plug circuits (P), and a bit (D6) to initiate a diagnostic routine.

16. The method of claim 15, wherein said data word includes an additional bit (D7) for reserved or special control functions.

17. The method of claim 10, including the step of providing glow plug current to said glow plug circuits (2, P) in pulsed form;

and wherein said serially transmitted bits defining the data word control the duty cycle of the pulsed current being applied to said glow plug circuits.

18. The method of claim 17, including the step of changing the duty cycle of said pulsed current supplied to the glow plug circuits as a function of an operating characteristic of said engine or said circuits.

19. The method of claim 18, wherein said step of changing the duty cycle as a function of an operating characteristic of said glow plug circuits comprises changing the duty cycle as a function of glow plug operating circuit voltage.

20. The method of claim 17, wherein said step of changing the duty cycle of the glow plug operating current comprises changing the duty cycle in dependence on whether the engine has started and disconnecting glow plug circuit operating current when the engine has operated for a predetermined time period.

* * * * *